United States Patent [19]

Edwards

[11] 4,005,648

[45] Feb. 1, 1977

[54] TRASH COMPACTOR

[75] Inventor: Earl S. Edwards, Windsor, Canada

[73] Assignee: McClain Industries Inc., Utica, Mich.

[22] Filed: Apr. 28, 1975

[21] Appl. No.: 572,110

[52] U.S. Cl. ..... 100/53; 100/229 A

[51] Int. Cl.[2] ..... B30B 15/00

[58] Field of Search ..... 100/215, 53, 190, 216, 100/229 A; 53/124 B

[56] References Cited

UNITED STATES PATENTS

| | | | |
|---|---|---|---|
| 2,800,159 | 7/1957 | Walsh et al. | 100/53 |
| 2,916,985 | 12/1959 | Beach | 100/53 |
| 3,145,647 | 8/1964 | Dinkov et al. | 100/53 |
| 3,601,953 | 8/1971 | Boyd | 53/124 B |
| 3,807,295 | 4/1974 | Engebretsen | 100/53 |
| 3,901,139 | 8/1975 | Moriconi | 100/53 X |

*Primary Examiner*—Billy J. Wilhite
*Attorney, Agent, or Firm*—Barnes, Kisselle, Raisch & Choate

[57] ABSTRACT

A trash compactor comprising a body having a trash receiving area and an access door through which trash may be deposited to the trash receiving area. A vertically movable ram is movable from a position adjacent said access door to a compacting position. Means are provided operable by the downward movement of the ram to lock said access door during the downward movement of the ram.

6 Claims, 5 Drawing Figures

TRASH COMPACTOR

This invention relates to trash compactors.

BACKGROUND OF THE INVENTION

In both domestic and commercial applications, it has become common to provide a trash compactor wherein a vertically movable ram functions to compact the trash. In such devices, an access door is often provided. For safety, it is desirable to lock the access door during downward movement of the ram in order to prevent the hand of a user from being trapped beneath the ram.

Among the objects of the invention are to provide a trash compactor having an automatically mechanically actuated lock which is actuated upon downward movement of the ram to lock the access door and upon upward movement of the ram to unlock the access door; wherein such a locking construction is achieved in a simple and inexpensive manner; wherein the locking function is positive and certain.

SUMMARY OF THE INVENTION

In accordance with the invention, means are provided which are operated automatically to the downward movement of said ram to lock mechanically the access door during the downward movement of the ram.

DESCRIPTION

Figure 1:
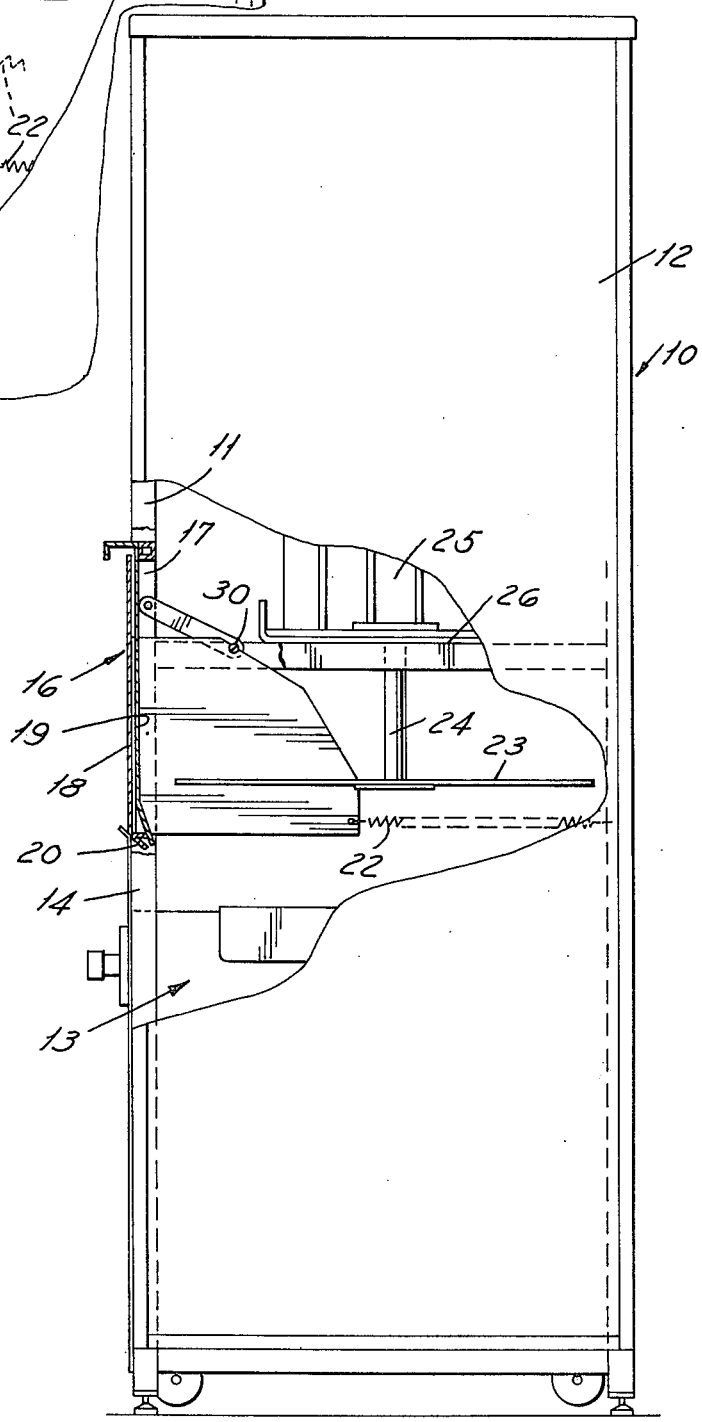
FIG. 1 is a part sectional side elevational view of a trash compactor embodying the invention.
Figure 3:
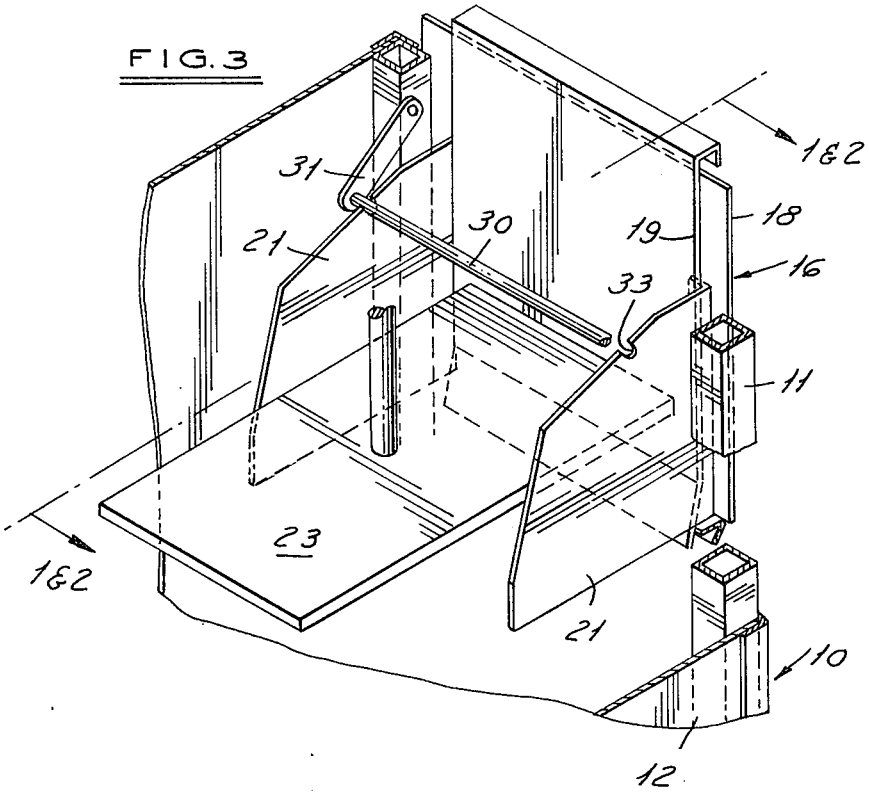
FIG. 3 is a fragmentary perspective view, parts broken away.

Referring to FIG. 1, the trash compactor embodying the invention comprises a body 10 which includes a frame 11 and a housing 12. The housing comprises a plurality of panels enclosing the frame 11. A trash receiving area is provided within the body 10 and preferably a trash cart 13 is movable into the area with the front panel 14 of the trash cart 13 forming the front panel of the trash compactor. The cart is provided with wheels 15 and is adapted to receive a flexible plastic trash receiving bag.

The compactor 10 further includes an access door 16 that is pivoted for providing access through an opening 17 for delivering the trash to the trash receiving area of the cart 13. The access door 16 is shown as comprising spaced panels 18, 19, the lower ends of which are spaced apart to provide a pivot on a cross bar 20 of the frame 11. The access door 16 further includes wing panels 21 extending rearwardly from panels 18, 19. Tension springs 22 extend from the wing panels to the rear of the frame 11 to urge the access door 16 to a closed position. A ram or compactor blade 23 is mounted on the lower end of a piston rod 24 of a cylinder 25 which is mounted on a support plate 26 extending horizontally in the frame 11. The compactor blade 23 moves from a position adjacent the opening 17 to a position within the cart for compacting the trash.

In accordance with the invention, means are provided for mechanically locking the access door automatically when the ram 23 moves downwardly and unlocking the access door automatically when the ram 23 moves upwardly to its original position.

Figure 2:
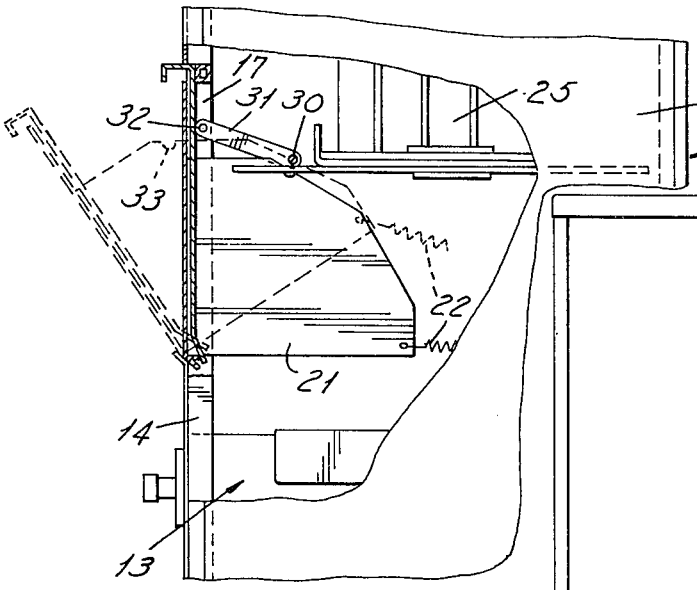
FIG. 2 is a fragmentary part sectional side elevational view of the compactor showing the parts in a different operative position.

As shown, this comprises a transverse rod 30 pivotally mounted by arms 31 to the front frame members as at 32. The rod is adapted to engage opposed notches 33 in the wing panels 21. When the ram 23 is in the upper position as shown in FIG. 2, the top side of the ram 23 engages the rod 30 and holds the rod 30 out of engagement with the notches 33 so that the access door can be opened for introducing trash. As the ram is lowered by the action of the cylinder 25, it moves away from the rod 30 permitting the rod 30 to move under the action of gravity into the notches 33 and thereby lock the access door 16. As the ram 23 is returned to its original position, the top surface of the ram 23 engages the rod 30 to lift the rod 30 out of the notches 33 and thereby unlock the access door 16.

In event that the door 16 is being held open when the ram 23 begins to move downwardly, when the door 16 is released, the springs 22 will return the door 16 to a position wherein the notches 33 will engage the bar 30.

Figure 4:
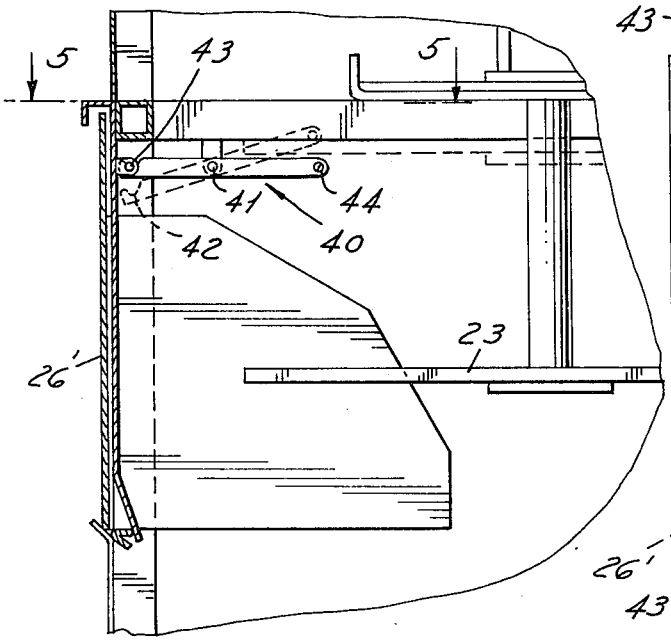
FIG. 4 is a part sectional side elevational view of a modified form of trash compactor.
Figure 5:
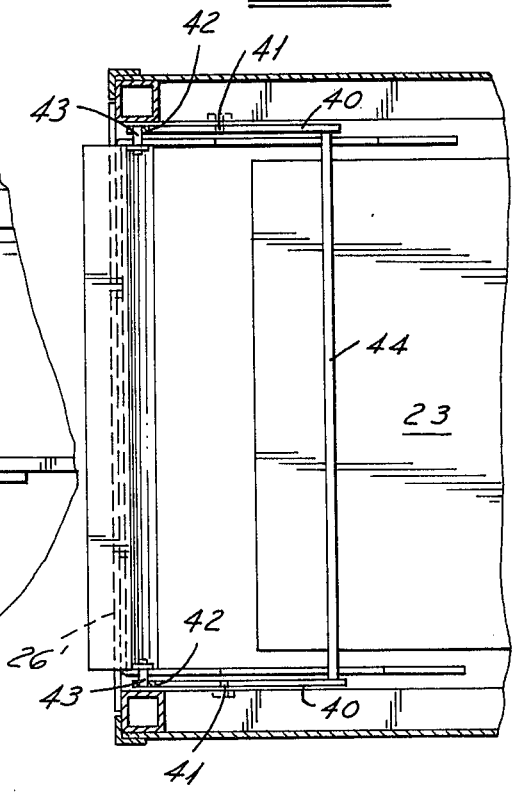
FIG. 5 is a fragmentary sectional view taken along the line 5—5 in FIG. 4.

In the modified form of the invention shown in FIGS. 4 and 5, locking levers 40 are pivoted at 41 intermediate their ends to the frame and have hooks 42 at one end which engage pins 43 on the access door 26'. A rod 44 connects the other ends of the levers 40 and is adapted to engage the upper surface of the ram 23 when the ram 23 is in its upper position. As in the previous form of the invention, when the ram 23 descends, it moves away from the rod 44 permitting the rod 44 to move under the action of gravity in a clockwise direction as viewed in FIG. 4 and cause the hooks 42 to engage the pins 43 on the door 26' and thereby lock the door 26'. When the ram returns to its original position, the upper surface thereof engages the bar 44 moving the levers 40 in a counterclockwise manner to disengage the hooks 42 from the pins 43 and unlock.

It can thus be seen that there has been provided a simple and inexpensive construction for positively locking the access door mechanically upon movement of the ram downwardly into trash compacting position and for unlocking the access door when the ram returns to its original position.

I claim:

1. In a trash compactor, the combination comprising a body,
   said body having a trash receiving area,
   an access door through which trash may be deposited to said trash receiving area,
   and a vertically movable ram,
   means for moving said ram from a position adjacent said access door to a compacting position in said trash receiving area,
   and means operable by the ram upon downward movement of said ram to lock said access door during the downward movement of the ram and operable by the ram upon upward movement of the ram to unlock the access door,
   said last-mentioned means comprising a gravity operated lock engaging said access door,
   said lock being actuated upon downward movement of said ram and being disengaged upon upward movement of said ram to its original position, said gravity operated lock comprising a pair of levers pivoted intermediate their ends to said body, each said lever having a hook at one end thereof, said door having means thereon engageable by said hooks to lock said door under the action of gravity on said rods and levers, a rod interconnecting the other ends of said levers, said ram being adapted to engage said rod to move said lever to unlock said access door upon upward movement of said ram.

2. In a trash compactor, the combination comprising a body, said body having a trash receiving area, an access door through which trash may be deposited to said trash receiving area, and a vertically movable ram, means for moving said ram from a position adjacent said access door to a compacting position in said trash receiving area, and gravity operated lock means mounted on said body and having engaging means normally urged by gravity in a direction to interengage said access door to lock said door, said gravity operated lock means being operable by the ram upon downward movement of said ram to permit said engaging means to move by the action of gravity in a direction to engage said access door and lock said access door during the downward movement of the ram and operable by the ram upon upward movement of the ram to disengage said engaging means against the action of gravity and unlock the access door, said door being pivoted about its lower end to said housing and said gravity operated lock means comprising a lever pivoted to said body intermediate its ends, said engaging means being on one end of said lever, means extending from the other end of said lever and being adapted to be engaged by said ram upon upward movement of said ram to unlock said access door.

3. The combination set forth in claim 2 including a pin on said access door, said engaging means comprising a hook on said one end of said lever and adapted to engage said pin.

4. The combination set forth in claim 3 wherein a substantially identical gravity operated lock is provided on each side of the door.

5. In a trash compactor, the combination comprising a body, said body having a trash receiving area, an access door through which trash may be deposited to said trash receiving area, and a vertically movable ram, means for moving said ram from a position adjacent said access door to a compacting position in said trash receiving area, and gravity operated lock means mounted on said body and having engaging means normally urged by gravity in a direction to interengage said access door to lock said door, said gravity operated lock means being operable by the ram upon downward movement of said ram to permit said engaging means to move downwardly by the action of gravity in a direction to engage said access door and lock said access door during the downward movement of the ram and operable by the ram upon upward movement of the ram to disengage said engaging means against the action of gravity and unlock the access door, said access door being pivoted to said housing at its lower end about a horizontal axis and said gravity operated lock means comprising arms pivoted to said body, a rod extending between said arms, said rod comprising said engaging means, said access door including wing panels having notches therein adapted to be engaged by said rod, said rod being adapted to be engaged by said ram upon upward movement of said rod.

6. In a trash compactor, the combination comprising a body, said body having a trash receiving area, a pivotally mounted access door through which trash may be deposited to said trash receiving area, and a vertically movable ram, means for moving said ram from a position adjacent said access door to a compacting position in said trash receiving area, and gravity operated lock means mounted on said body and having engaging means normally urged by gravity in a direction to interengage said access door directly to lock said door, said gravity operated lock means being operable by the ram upon downward movement of said ram to permit said engaging means to move downwardly by the action of gravity to engage said access door directly and lock said access door during the downward movement of the ram and operable by the ram upon upward movement of the ram to disengage said engaging means from said door against the action of gravity and unlock the access door.

* * * * *